United States Patent [19]

Olsson

[11] 4,020,890

[45] May 3, 1977

[54] METHOD OF AND APPARATUS FOR EXCLUDING MOLTEN METAL FROM ESCAPING FROM OR PENETRATING INTO OPENINGS OR CAVITIES

[76] Inventor: Erik Allan Olsson, Oerlikonerstrasse 88, Zurich, Switzerland

[22] Filed: Aug. 13, 1975

[21] Appl. No.: 604,428

[30] Foreign Application Priority Data

Nov. 17, 1974 Switzerland ..... 14657/74
Nov. 17, 1974 Switzerland ..... 14659/74

[52] U.S. Cl. ..... 164/49; 164/147; 164/250; 164/278

[51] Int. Cl.[2] ..... B22D 27/02

[58] Field of Search ..... 164/48, 49, 82, 87, 164/88, 147, 250, 273 R, 276, 278

[56] References Cited

UNITED STATES PATENTS

| | | | |
|---|---|---|---|
| 2,852,821 | 9/1958 | Pond | 164/278 |
| 3,467,166 | 9/1969 | Getselev et al. | 164/49 |

*Primary Examiner*—Gil Weidenfeld
*Attorney, Agent, or Firm*—Parmelee, Miller, Welsh & Kratz

[57] ABSTRACT

Molten metal is confined to a particular space or excluded from entering some opening or crevice by utilizing the field around an electrical conductor connected with a source of alternating current to repel the molten metal from the opening or crevice, resulting in better and more uniform continuous castings.

11 Claims, 10 Drawing Figures

METHOD OF AND APPARATUS FOR EXCLUDING MOLTEN METAL FROM ESCAPING FROM OR PENETRATING INTO OPENINGS OR CAVITIES

In many metallurgical processes involving the transfer of molten metal from one element to another or from a liquid to a solid state, as in continuous casting operations, there are crevices or openings into which the metal flows and congeals to form fins or uneven edges on a casting or block, some necessary gas escape passage, or otherwise interfere with or adversely affect the forming or cooling of the metal in such manner as to destroy the uniformity of the solidified metal.

For example, in a simple operation where a rotating chilled roll dips into molten metal in a container so that a continuous film of metal forms on the surface of the roll from which it is to be subsequently stripped as a continuous thin sheet, as shown for example in my copending application Ser. No. 537,561 now U.S. Pat. No. 3,971,123 filed as a continuation of application Ser. No. 337,931 dated Mar. 5, 1973 (now abandoned), the molten metal between the end of the roll and the side wall of the vessel in which the roll revolves partially cools to a mush-like consistency that will reenter the body of metal in the vessel, producing nodules that impair uniform quality of metal in the film being formed. In other instances the metal solidifies between the end of the roll and the wall or on the end of the end edges of the roll producing ragged, irregular or torn edges along the sides of the sheet which is being produced on the rotating roll.

In numerous other operations the molten metal may tend to overflow the edges of a mold, particularly where metal in a receptacle is being forced upward against a chilled moving surface or roll. Even in more conventional continuous casting operations where the molten metal is poured into the top of a reciprocating open-ended mold, overflow of the molten metal at the top of the open-ended mold may be a problem. Another typical instance where the escape of molten metal or the forming of fins along the edges of the casting is a serious problem occurs in continuous casting machines where molten metal is cast into the thin space between the confronting reaches of two continuously-moving endless belts—a process sometimes referred to as the "Hazelett" method.

Other instances could be described, but the ones above mentioned comprise typical illustrations of the type of problem with which the present invention is concerned, and for which it provides at least important corrective measures, if not complete elimination of these difficulties.

Brief Description

It is well known that when a conductor carrying alternating current is positioned to induce eddy currents in a non-magnetic conducting body, a repulsive force is generated between the two. Molten Steel or molten ferrous alloys are non-magnetic conductors and this repulsive force is demonstrated where metal is melted in the crucible of an induction furnace (which has no core) where the molten metal bulges up in the crucible demonstrably more when the surrounding inductance is energized than when it is not because of molten metal being repelled in this manner away from the walls of the mold, thereby in effect, reducing the cross-sectional area of the mold wth the molten metal being displaced upwardly. In a so-called channel type of induction furnace (where there is a core) it has been observed that if the inductive field surrounding the channel is too strong, the flow of metal will be restricted and even entirely squeezed off by this repulsive force.

According to the present invention this phenomenon is put to a useful purpose by incorporating a conductor connected with a source of alternating current in an apparatus where molten metal may otherwise leak or overflow from some vessel or other element or combination of elements where such leakage or overflow is detrimental to the proper functioning of the apparatus comprising such vessel or elements. Thus, in an apparatus where a cooled roll revolves in a vessel containing molten metal a conductor located on or in the side wall of the vessel may controllably repel the molten metal from the spaces between the ends of the roll and the side walls of the vessel. Likewise, in casting processes of the type where molten metal is introduced into the space between the confronting reaches of two driven endless belts where the belts are driven in opposite directions with the result that the two confronting reaches travel in the same direction, conductors connected with an alternating current source prevent the molten metal which flows from a delivery trough into the space between the belts from spreading laterally beyond defined limits and retains it between such limits until the metal has solidified to a point where such control is no longer required. Even in a simple duct system where molten metal may flow from one end of a stationary tube into the confronting end of a rotating tube an encircling conductor energized from an alternating current source around the space between the two ends will exclude the molten metal from escaping into the space between the two tube ends.

The invention may be more fully understood by reference to the accompanying schematic drawings which are illustrative of the invention and in which.

Figure 3:
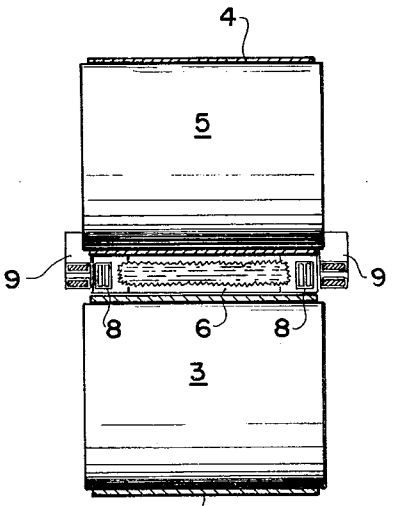
FIG. 3 is a transverse vertical section in the plane of line III—III of FIG. 1.
Figure 1:
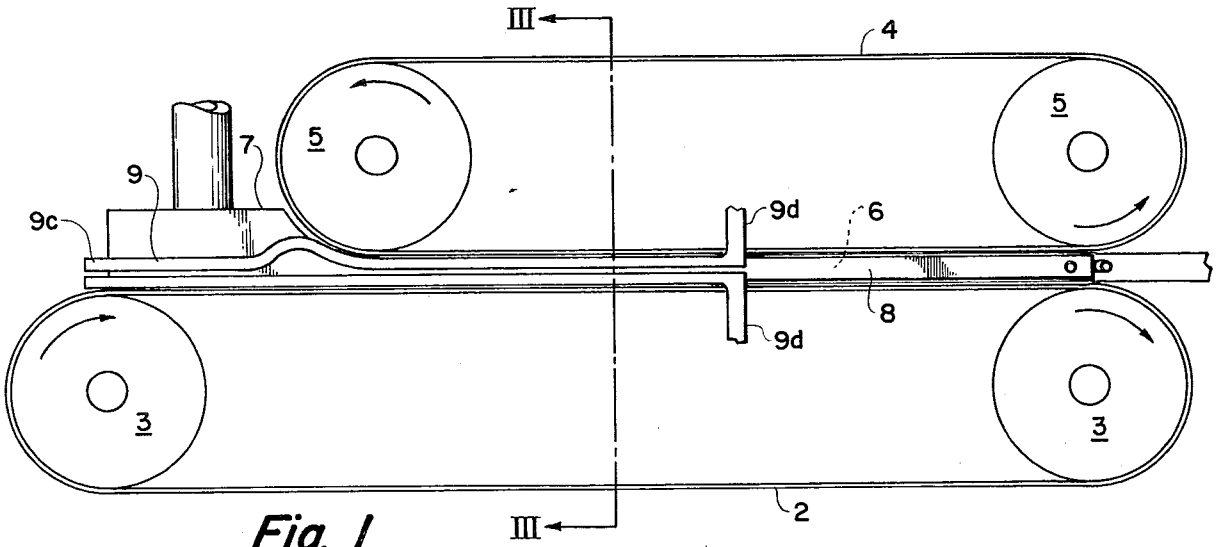
FIG. 1 represents in side elevation a continuous casting unit of the type where molten metal is introduced into the space between the confronting reaches of two oppositely-moving endless belts, the molten metal solidifying as it is carried along between the belts, an alternating current conductor being incorporated in the machine for the practice of my invention.
Figure 2:
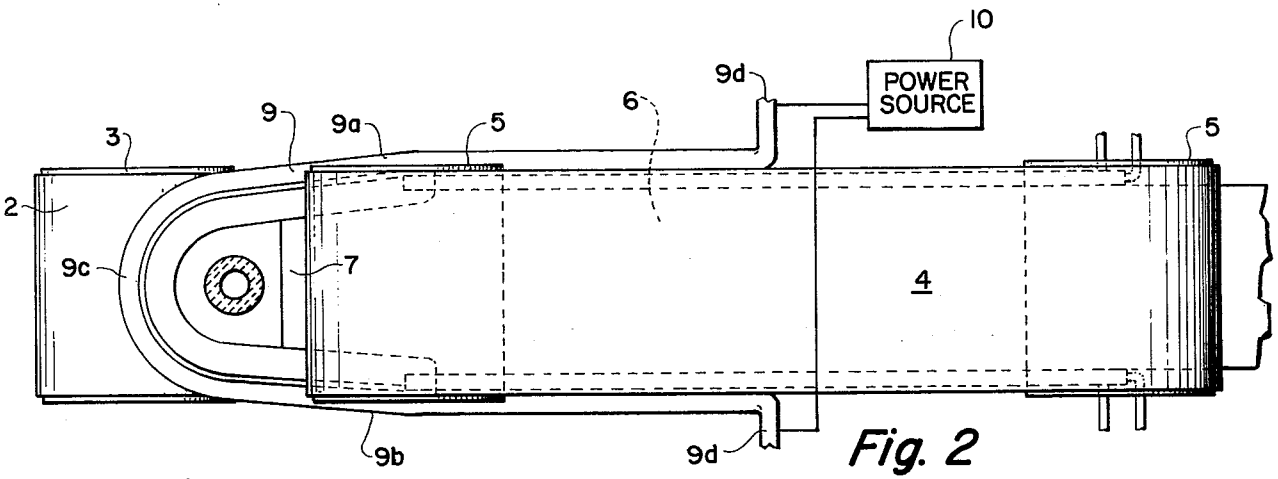
FIG. 2 is a plan view of the casting machine shown in FIG. 1.

Referring first to the apparatus shown in FIGS. 1 to 3, the casting apparatus is of the type sometimes referred to as a Hazelett type of continuous casting machine having an endless belt 2 passing around supporting rolls 3 at opposite ends, one of which is usually driven so that the belt as here shown travels in a clockwise direction. Above it is a second endless belt 4 passing around rolls 5 and driven in a counterclockwise direction so that the upper run or reach of the lower belt and the lower run of the upper belt, defining between them a mold cavity 6, move in the same direction and at the same speed.

Machines of this type are well known in the art and there is a trough 7 at the forward end of the machine which receives molten metal and discharges it at the left end of the upper belt into the space 6 between the two confronting runs of these belts.

As here shown there is a fixed wall 8 along each side of the cavity 6 to confine the molten metal while it is solidifying between the two belts to emerge as a continuous casting at the right end of the machine.

A practical difficulty with all machines of this type has resulted from there being no way to provide an effective seal against the molten metal seeking to escape from between the trough 7 and the ends of the side walls 8, and from seeking to enter and solidify between the moving belts and the fixed side guides. Also there is difficulty in preventing the molten metal from escaping where the upper reach of the lower belt passes under the trough 7.

According to the present invention a U-shaped conductor 9, preferably tubular and comprised of one or more strands or turns, embraces the critical length of the machine with one leg 9*a* extending along the outside of one side wall 8 and the other leg 9*b* extending along the outside of the other guide 8 while the connecting portion 9*c* of the U, or yoke, fits around the base of the trough 7 over the lower belt.

Terminals 9*d* are connected with a soruce of alternating current, either single-phase or multi-phase, depending on the conductor arrangement. An alternating current source is schematically indicated in FIG. 2 at 10. By making the conductor tubular, it may be fluid-cooled by water or other fluid.

With the casting machine in operation the conductor or conductor system is connected in series with the alternating current source so that a field with lines of force at right angles to the conductor is generated about the conductor. The energizing of the conductor therefore immediately results in generating eddy currents in the molten metal in the trough and from the sides of the mold space to these induced currents repelling the molten metal in a direction away from the conductor and hence from crevices or passages through which the molten metal could otherwise enter and freeze or escape.

The critical area is around the refractory trough and its termination at the side walls and between the side walls and the belts for a distance where the metal remains fluid, but after solidification occurs the conductor is no longer necessary. For this reason the conductors 9*a* and 9*b* extend only part way from the trough along the sides of the casting machine. The molten metal is therefore repelled from escape at the rear of the trough, or along its sides, and if the side walls 8 are non-magnetic, the molten metal is repelled from them sufficiently to prevent freezing of the molten metal to the side walls until the metal has solidified to a point where the edges of the developing castings are no longer liquid.

Figure 4:
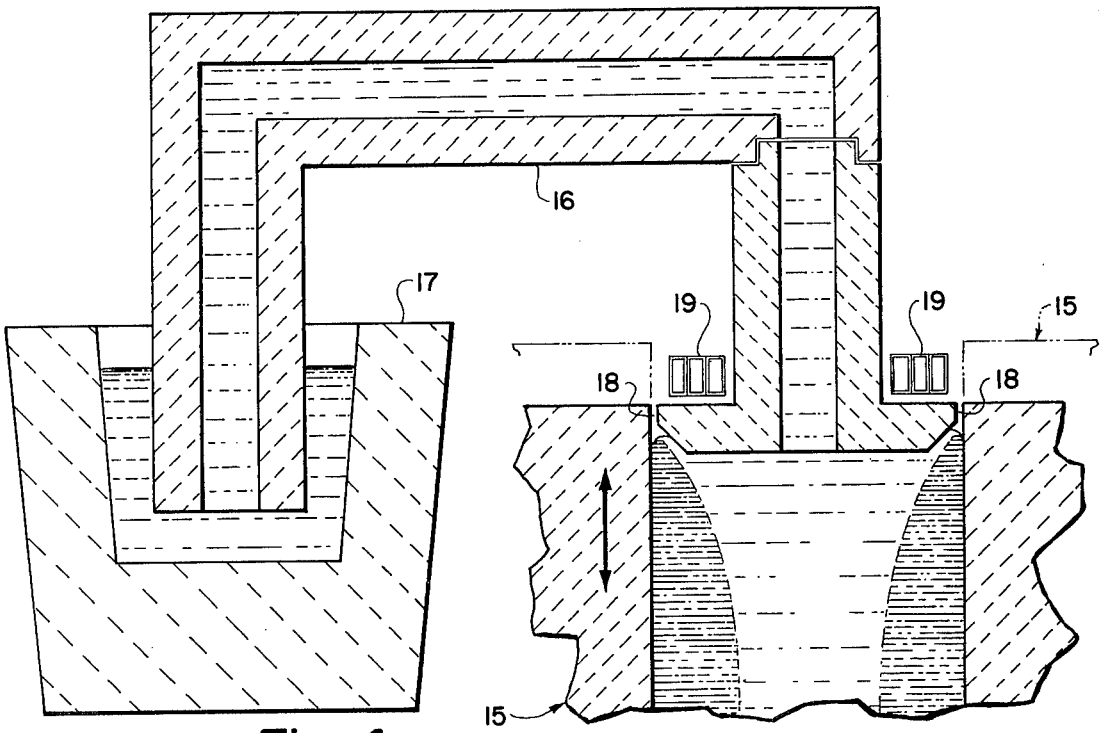
FIG. 4 is a vertical section through a vertically reciprocating continuous casting mold and a stationary syphon through which metal is introduced into the mold, the apparatus having my invention incorporated therein.

In FIG. 4 there is shown a continuous casting machine having a mold 15 supplied with molten metal through a syphon 16 from a container 17. The molten metal is induced to move through the syphon by any one of a number of selected methods, e.g., a vacuum syphon, electromagnetic propulsion, or by gas pressure. In FIG. 4 the mold reciprocates relative to the syphon, so that there is a crevice or space 18 through which metal can escape. In fact some clearance between the mold and syphon is desirable for the purpose of permitting the escape of gas in this location. Escape of gas without escape of metal is prevented by the provision of one or more convolutions of a conductor 19 around the lower end of the syphon, connected, of course, with a source of alternative current (not shown).

Figure 5:
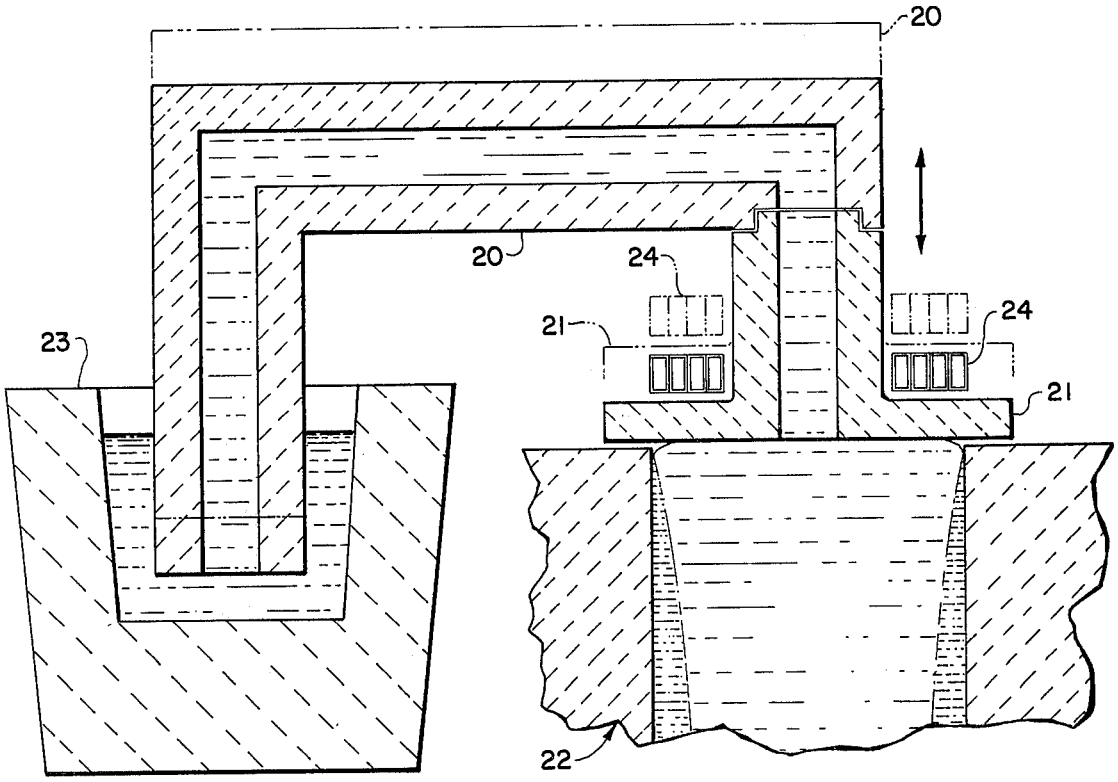
FIG. 5 is a view similar to FIG. 4 in which the syphon reciprocates vertically with the mold.

FIG. 5 shows a slight modification where the syphon 20 has a flange 21 above the top of the continuous casting mold 22, so that the syphon reciprocates vertically with the mold. As in FIG. 4 the other leg of the syphon dips into a molten metal holding vessel 23 similar to 17 in FIG. 4. Here the several turns of the conductor 24 are above the flange on the syphon where the magnetic field restrains the escape of molten metal from between the top of the mold and the flange of the syphon, but does not interfere with the escape of gas from the mold.

Figure 6:
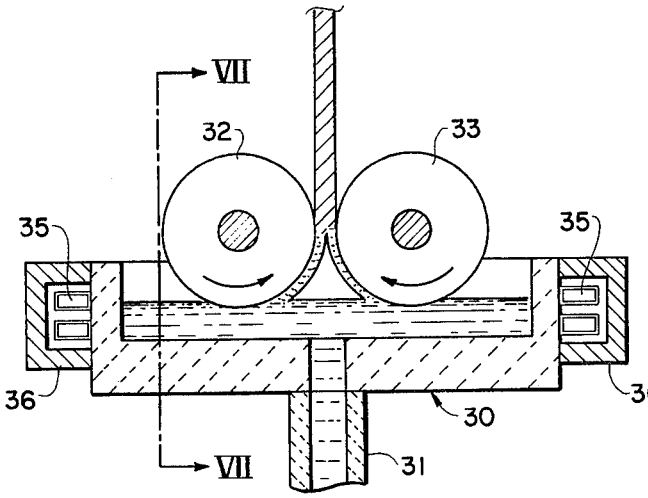
FIG. 6 is a side elevation of a casting machine of the type in which a pair of oppositely-rotating rolls have their lower portions dipping into a vessel containing molten metal.
Figure 7:
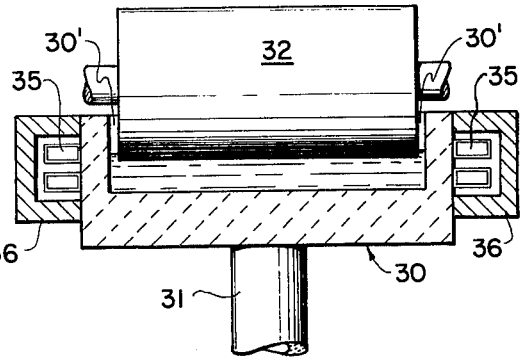
FIG. 7 is a transverse section in the plane of line VII—VII of FIG. 6.

Referring to FIGS. 6 and 7 there is disclosed a casting machine having a refractory or refractory-lined vessel 30 with an inlet 31 for supplying molten metal to the vessel and maintaining a constant depth of molten metal thereon. There are one or more cooled rolls that are rotatably supported so that the lower arc dips to a predetermined depth into the molten metal. In FIG. 6 two such rolls are shown, these being designated 32 and 33. Their axes of rotation are above the top of the vessel 30, means for rotating them not being shown. If desirable these rolls may be arranged as disclosed in my said copending application Ser. No. 537,561.

A difficulty with a casting apparatus of this type using cooled dip rolls is that the molten metal between the side walls 30′ of the vessel and the clearance spaces between the ends of the rolls 32 and 33 tends to cool and thicken and even solidify. This causes the edges of the layer of congealed metal formed on the periphery of a roll to be ragged and uneven and the partially cooled metal being circulated into the more fluid body of metal in the vessel tends to produce nodules or nuclei for crystal formations that destroy uniformity in the film of metal that congeals on the surface of each roll. This cooling of the metal in these spaces also produces mechanical drag on the rotation of the rolls.

With the present invention one or more convolutions of a conductor 35 surround the vessel 30 at about the level of the liquid metal in the vessel, this conductor being in series with a source of alternating current (not shown). When the conductor is energized the magnetic field tends to repel the liquid metal away from the side walls of the vessel and prevents it from rising in the restricted space between the end walls of the rolls and the sides of the vessel. To some extent this magnetic field may even control the width of the layer of metal which congeals on the roll or rolls.

A magnetic yoke, indicated at 36, comprised of magnetic or magnetizable metal, may be provided to enclose the conductor 35 as shown to reduce loss of energy by stray eddy current losses and increase the effectiveness of the field around the conductor.

Figure 8:
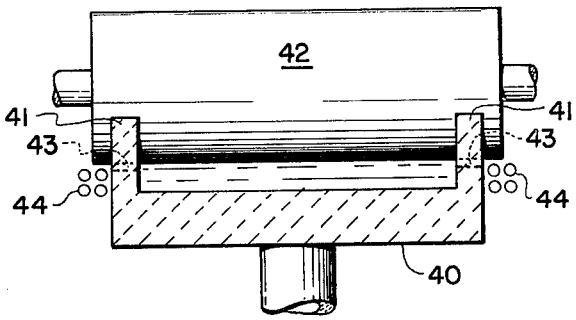
FIG. 8 is a view similar to FIG. 7 of a modified form of apparatus as disclosed in FIG. 7.

In some cases, a roll will have one or both ends received in arcuately-conforming recesses in the side walls of the vessel, as shown in FIG. 8, where the vessel 40 has its side walls 41 recessed to receive the lower portion of the periphery of a roll 42, or if there are more than one roll, of each roll. This has the advantage of eliminating the gap between the end faces of the rolls and the side walls, as in FIGS. 7 and 8, but gives rise to the problem of metal escaping between the side walls and the periphery of each roll at 43. This may be overcome by placing a conductor, as in FIGS. 6 and 7, around the vessel under the projecting ends of the rolls as indicated at 44 where it tends to repel the molten metal away from the side walls and hence from escaping through the crevice or clearance space at 43.

Figure 9:
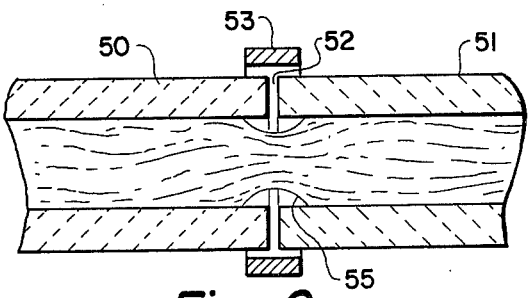
FIG. 9 is a longitudinal section between two relatively movable pieces, with this invention being applied to prevent escape of liquid metal.
Figure 10:
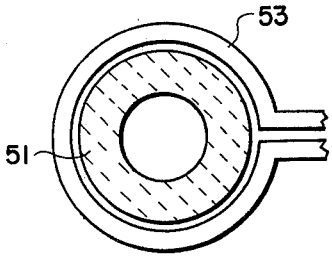
FIG. 10 is a transverse section in the plane of line X—X of FIG. 9.

FIGS. 9 and 10 show a simple adaptation of the principles of this invention wherein 50 and 51 are the confronting ends of refractory tubes through which molten metal is conducted. It could be that one tube rotates relative to the other, or that for some other reason an annular clearance space 52 is provided between the tube ends. According to this invention a conductor 53, which may comprise one or more convolutions or turns and which may be water-cooled, encircles the gap 52. The opposite ends **52*a* and 52*b* of the conductor are connected to a source of alternating current (not shown). The effect of the field generated by the conductor is indicated in FIG. 9, where the metal flow at 55 is repelled around the entire periphery of the stream from the gap 52**.

No empirical formula can be defined for all operations and apparatus, since it will vary with the geometry of each particular apparatus, its dimensions, the wall thicknesses of various refractory vessels, necessary mechanical clearances and various other individual shielding and distortion factors entering into the structure of each machine or type of machine. The amount of power at a given frequency can be readily determined by one skilled in the art by experimentation. Certain formula may be used to advantage.

It is known that when an electromagnetic wave encounters a non-magnetic body, including molten metal, the wave will exert a (radiation) pressure upon the object according to Esmarch which is determined by the following equation:

$$P_s = \frac{31.6}{\sqrt{\frac{rf}{u}}} \times P_{if} \times 10^{-4}\ \text{kp/cm}^2$$

where $P_s$ = the repulsing pressure in kilopond (kp) per sq. cm.

$P_{if}$ = the induced power in the metal body in *k*W per sq. meter $r$ = the specific restivity of the metal *u* Ohms × *m*

$f$ = frequency in Hertz $u$ = the permeability of the metal

At an absorbed (i.e., induced) power of $P_{if}$/kW/m² in the molten metal and a specific resistance of 1.4 *u*Ohm per meter of molten metal and a current frequency 50 cycles (and permeability where $u = 1$, the repulsing force will be:

$$P_s = \frac{31.6}{\sqrt{\frac{1.4 \times 50}{1}}} \times 1 \times 10^{-4}\ \text{kp/cm}_2$$

$P_s$=0.000378 kp/cm$_2$ = 0.378 pond/cm² pro 1 kW/m$_2$ induced (absorbed) power A liquid steel layer 1 cm in height or thickness has a weight of approximately 0.7 pond per sq. cm; and 5 kW induced power would thus be necessary for counterbalancing or being equivalent to this weight.

The $P_{if}$ factor is one which cannot be empirically stated for all installations but must be determined for each installation.

The equation for the calculation of $P_{if}$ in kW/m² is:

$$P_{if} = 1.987 \times 10^{-9} \times H^2 m \quad \sqrt{\text{r.u.f.}}\ \text{kW/m}^2$$

wherein $H$ = the magnetic field at the surface of a body in A/m (RMS value)

$r$ = the specific restivity of the metal in u Ohms × m $f$ = the frequency in Hertz $m$ = a geometrical correction factor.

In the foregoing equations the unit "pond" or *p* is based on the distinction between mass or weight as expressed in grams, or kilograms and force where the acceleration of gravity is a factor and replaces the older and less frequently used terms "gram force" (gf) and kilogram force (kgf) in the metric system, or the term "pound force" in the English system of weights. The equations here expressed in the metric system can of course be converted to the English system.

In a copending application based on Swiss application No. 14659 filed Nov. 16, 1974 which insofar as it is relevant is incorporated herein by reference, the repelling force generated in the manner herein described is utilized in various ways to limit or define the area on a moving chilled surface to which molten metal is applied to regulate its width, thickness, or both, in the process of continuously forming a thin, flat strand of metal directly from the molten state, the chill surface being provided either by a revolving roll or an endless belt or web and it incidentally may also confine the metal from entering some crevice, as herein described.

I claim:

1. Apparatus for casting and shaping molten metal into a solidified product, comprising:

a. a molten metal delivery element arranged to receive molten metal from a source of supply;

b. a molten metal receiving element positioned in fixed relation to said delivery element and arranged to receive metal in an entirely molten condition from said delivery element, said receiving element comprising a mold cavity into which the molten metal from the delivery element flows and is solidified;

c. the delivery element having a discharge terminal spaced from the receiving element providing a gap across which molten metal flows from the delivery element to the receiving element; and d. an electrical conductor connected in series with a source of alternating current and positioned about the gap where an electromagnetic field, that is generated about the conductor when the conductor is energized, serves to confine the flow of molten metal from escape as it flows in a liquid condition from the delivery element into the receiving element.

2. A hot metal casting apparatus as defined in claim 1 wherein said delivery element is a molten metal vessel having refractory side walls and the second element comprises at least one driven and cooled dip roll so positioned that its lower portion revolves through molten metal in the vessel, the ends of the dip roll being separated from each of the side walls of the vessel by a clearance space, the conductor surrounding the vessel at about the level of the molten metal in the vessel, the current flow through the conductor being sufficient to exclude the molten metal in the vessel.

3. A hot metal casting apparatus as defined in claim 2 wherein said receiving element comrpises a pair of oppositely-rotating parallel dip rolls spaced from each other to provide a pass between them in which layers of metal formed on the respective rolls are combined into a single body above the level of the molten metal in said vessel.

4. In a hot metal casting apparatus as defined in claim 1 wherein said delivery element is a molten metal container with spaced refractory side walls and said receiving element is at least one dip roll extending crossways of the vessel and of a length greater than the width of the vessel and the lower peripheral arc of which dips into the molten metal in the vessel, the side walls of the vessel to a depth below said liquid level being cut away to conform to the contour of the said roll, said conductor being located outside the side walls of the vessel below the ends of the roll where it projects through said cutaway side walls to exclude the outflow of metal from the vessel in the spaces between the side walls and the roll ends.

5. A molten metal casting apparatus as defined in claim 1 in which said delivery element is a duct having a discharge end that engages the top of an open-ended continuous casting mold constituting said receiving element and the space is between the top of the mold and the end of said duct, the conductor encircling the duct adjacent said space to exclude metal therefrom while providing an opening for venting gases from the mold.

6. In the process where molten metal is transferred from a delivery element to a receiving element comprising a mold in fixed relation to the delivery element and there is a gap between the delivery and the receiving elements from which the molten metal could escape in flowing from one element to the other, the steps of excluding the molten metal from escaping at said gap which comprises positioning a conductor adjacent the gap and passing an alternating current through the conductor in such manner and of such strength that the field generated around the conductor will repel the molten metal and thereby prevent it from escaping through said gap, and maintaining the molten metal completely liquid until it enters the mold where it is then shaped and solidified.

7. Apparatus for casting and shaping molten metal as defined in claim 1 wherein the receiving element has confronting spaced mold walls which are substantially co-extensive in width and at least one of which comprises a moving member on which the molten metal is received and on which it solidifies, the said conductor having elongated extensions extending along each side of the mold cavity formed between said confronting mold walls, and which, when energized from the source of current, repel the molten metal as it enters the receiving member and during the time when the metal first flows into the mold cavity away from the edges of said cavity.

8. Apparatus for casting and shaping molten metal as defined in claim 7 in which the mold cavity extends generally horizontally away from the delivery element.

9. Apparatus for casting and shaping molten metal as defined in claim 13 wherein both of said confronting spaced mold walls are endless belts moving in a generally horizontal direction away from the delivery element.

10. Apparatus as defined in claim 8 wherein the said conductor extends crosswise of the mold cavity upstream with respect to the direction of travel of the movable member on which the molten metal solidifies and partially encircles the said gap, the conductor having extensions along each side of the mold cavity to repel molten metal from the edges of the mold cavity.

11. An apparatus for casting molten metal comprising two endless belts having confronting surfaces which are spaced from each other and which travel in the same direction, forming between them a generally flat, horizontally extending mold cavity, an electrical conductor extending along each side of the mold cavity from adjacent the place of discharge of molten metal into one end of the cavity at least part way along the sides of the cavity and arranged to produce an electromagnetic field effective to repel the molten metal from the sides of the cavity, and a source of alternating current connected with the conductors to generate a field thereabout of a selected strength and frequency to generate the field which repels the metal from the edges of the mold cavity until the metal solidifies.

* * * * *